US009907373B2

(12) United States Patent
Han

(10) Patent No.: US 9,907,373 B2
(45) Date of Patent: Mar. 6, 2018

(54) BAG FOR A MOBILE DEVICE USER WITH AN ADJUSTABLE SUPPORT BOARD

(71) Applicant: Min-Hyung Han, Seoul (KR)

(72) Inventor: Min-Hyung Han, Seoul (KR)

( * ) Notice: Subject to any disclaimer, the term of this patent is extended or adjusted under 35 U.S.C. 154(b) by 0 days.

(21) Appl. No.: 14/910,756

(22) PCT Filed: Aug. 5, 2014

(86) PCT No.: PCT/KR2014/007196
§ 371 (c)(1),
(2) Date: Feb. 8, 2016

(87) PCT Pub. No.: WO2015/020390
PCT Pub. Date: Feb. 12, 2015

(65) Prior Publication Data

US 2016/0192750 A1 Jul. 7, 2016

(30) Foreign Application Priority Data

Aug. 6, 2013 (KR) ..... 10-2013-0093220

(51) Int. Cl.
*A45C 9/00* (2006.01)

(52) U.S. Cl.
CPC ..... *A45C 9/00* (2013.01); *A45C 2200/15* (2013.01)

(58) Field of Classification Search
CPC ..... A45C 2200/15; A45C 9/00
(Continued)

(56) References Cited

U.S. PATENT DOCUMENTS 446,690 A * 2/1891 Nelson ..... A45C 9/00 190/2
3,544,157 A * 12/1970 Muller ..... A45C 9/00 297/118

(Continued)

FOREIGN PATENT DOCUMENTS

JP H11290112 A 10/1999
KR 200302833 A 1/2003

(Continued)

OTHER PUBLICATIONS

International Search Report and Written Opinion for International Application No. PCT/KR2014/007196 dated Nov. 28, 2014, 10 pages.

*Primary Examiner* — Sue A Weaver
(74) *Attorney, Agent, or Firm* — Billion & Armitage; Benjamin C. Armitage

(57) ABSTRACT

The present invention dicloses a bag for a mobile user.

A bag for a mobile device user according to the present invention comprises a body having a front side, a back side, lateral sides, a top side, and a bottom side; a support board being placed on the front side; a first multi-position fixing unit being pivotally provided to the lateral sides or the front side; a second multi-position fixing unit being provided to both sides, a bottom side, or an outer side of the support board, and being pivotally combined with the support board; and a support arm in which one end of the support arm is pivotally combined with the first multi-position fixing unit, while the other end of the support arm is pivotally combined with the second multi-position fixing unit, wherein a position of the second multi-position fixing unit is adjusted by a rotational movement of the first multi-position fixing unit, (Continued)

and a tilting angle of the support board is adjusted by a rotational movement of the second multi-position fixing unit.

9 Claims, 7 Drawing Sheets

(58) Field of Classification Search
USPC ..... 190/11
See application file for complete search history.

(56) References Cited

U.S. PATENT DOCUMENTS 3,557,916 A * 1/1971 Stowell ..... A45C 9/00 190/11
3,773,154 A * 11/1973 Mitchell ..... A47B 23/043 190/11
4,790,416 A * 12/1988 Baker ..... A47B 85/06 108/159
4,796,734 A * 1/1989 Distasio ..... A45C 3/10 135/95
7,841,473 B2 * 11/2010 Huang ..... A45C 5/03 206/320
8,613,349 B1 * 12/2013 Halko ..... A45C 9/00 190/11
2002/0178972 A1 * 12/2002 McNeil ..... A45C 13/00 108/42
2007/0145700 A1 * 6/2007 Ambrose ..... A45C 5/145 280/47.26
2008/0041683 A1 * 2/2008 Dorquez ..... A45C 9/00 190/11
2012/0175396 A1 7/2012 Patino
2013/0181101 A1 * 7/2013 Avganim ..... F16M 13/02 248/205.1
2016/0128454 A1 * 5/2016 Han ..... A45C 11/00 224/153

FOREIGN PATENT DOCUMENTS

KR 1020060112902 A 11/2006
KR 200453219 A 4/2011
KR 20120045941 A 5/2012
KR 20120081952 A 7/2012
KR 2020120008829 12/2012
KR 20130084128 A 7/2013

* cited by examiner

BAG FOR A MOBILE DEVICE USER WITH AN ADJUSTABLE SUPPORT BOARD

TECHNICAL FIELD

The present invention relates to a bag for a mobile device user.

More specifically, the present invention relates to a bag for a mobile device user where a front side of a main body of a bag is provided with an adjustable support board in a manner that the a main body of the bag is provided with a first multi-position fixing unit while the adjustable support board is provided with a second multi-position fixing unit wherein the first multi-position fixing unit and the second first multi-position fixing unit are combined pivotally using a support arm, thereby adjusting a position and a tilting angle of the adjustable support board so that the a mobile device user can use a mobile device in a stable and convenient way, help in physical health through keeping a proper posture of the user's body when using the mobile device, and have additional functions such as being used as a bookrest, etc.

BACKGROUND TECHNOLOGY

Generally, a mobile device user holds a mobile device with either one hand or two hands and uses it. After a user gets caught up on a mobile device for a long time on a chair or a sofa, prolonged holding of a mobile device leads to muscle fatigue of the lifted hands and arms. Thereafter, the user's hands and arms are naturally getting lowered downward as time passes, and thus the user mostly continues to use the mobile device, keeping a poor posture as illustrated in FIG. 15. Due to the overuse of a mobile device in keeping such a poor posture for a long time, the user's body is gradually transformed into a problematic body configuration. In addition, a user looks continuously downward with too much close distance between the user's eyes and the mobile device, which makes easily the user to become short-sighted or amblyopic. The current trend of a mobile device including a smartphone, a smart pad, a tablet PC, a portable game station, and e-book reader, etc. constantly seeks a large screen, multi-functionality, and high performance so that size and weight of the mobile device are gradually increasing. As a result, the user's body configuration is placed under a poor environment more and more due to an increased weight and viewing a large screen of a mobile device.

Therefore, the more the user spends a long time with a mobile device, the higher the user is possible to get chronic diseases such as a herniated cervical disc, a lumbar herniated intervertebral disc, elbow disease, carpel tunnel syndrome, and deteriorated vision, etc.

Further, a user's head is deeply lowered due to the poor posture of a user as illustrated in FIG. 15, which causes a lot of neck creases affecting a bad effect to a female person in terms of beauty care.

As prior arts regarding a bag relating to a mobile device, Korean Utility Model Registration No. 20-0302833, entitled "KNAPSACK TYPE AUDIO AND VIDEO SYSTEM," discloses a configuration where audio and video devices are inputted into an inside of a knapsack and are used at home, out of door, and in a vehicle. Further, Korean Patent Laid-Open Publication No. 10-2006-0112902, entitled "HOLDER CONNECTED WITH A STRIP OF A BAG", discloses a configuration where a mobile device for voice communications is held on a strap of a bag. Further, Korean Utility Model Registration No. 20-0453219, entitled "Tablet PC Case Which Is Removable from The Bag", discloses a configuration where a tablet PC, etc. is held on one side of a bag. Further, US Patent Application Publication No. 2012-0175396, entitled "Structural support device for laptop and portable electronic device carrying cases", discloses a configuration where a user carries a notebook computer inside of a bag or a shoulder bag and uses the notebook computer by opening a front side thereof while wearing the bag on the user's body. Further, Korean Utility Model Laid-Open Publication No. 20-2012-0008829, entitled "Handle Bag for Smart Mobile Phone Holder", discloses a configuration where a groove is formed on a handle of a bag and a smart phone is inserted and fixed in the groove.

However, although the prior arts described above merely provide partial alternatives to solve the problems occurring from the use of a mobile device, and thus do not suggest sufficient solution thereto.

Further, the prior arts described above are not sufficiently enough to provide all the users of the mobile device with convenience to a level for them to be satisfied.

Accordingly, a new breakthrough for solving the aforementioned problems is required.

DETAILED DESCRIPTION

Technical Problem to be Solved

The object of the present invention is to solve the prior art problems, by providing a bag for a mobile device user where a front side of a main body of a bag is provided with an adjustable support board in a manner that the a main body of the bag is provided with a first multi-position fixing unit while the adjustable support board is provided with a second multi-position fixing unit wherein the first multi-position fixing unit and the second first multi-position fixing unit are combined pivotally using a support arm, thereby adjusting a position and a tilting angle of the adjustable support board so that the a mobile device user can use a mobile device in a stable and convenient way, help in physical health through keeping a proper posture of the user's body when using the mobile device, and have additional functions such as being used as a bookrest, etc.

Technical Solution

According to one aspect of the present invention, the present invention provides a bag for a mobile device user comprising a body having a front side, a back side, lateral sides, a top side, and a bottom side; a support board being placed on the front side; a first multi-position fixing unit being pivotally provided to the lateral sides or the front side; a second multi-position fixing unit being provided to both sides, a bottom side, or an outer side of the support board, and being pivotally combined with the support board; and a support arm in which one end of the support arm is pivotally combined with the first multi-position fixing unit, while the other end of the support arm is pivotally combined with the second multi-position fixing unit, wherein a position of the second multi-position fixing unit is adjusted by a rotational movement of the first multi-position fixing unit, and a tilting angle of the support board is adjusted by a rotational movement of the second multi-position fixing unit.

Advantageous Effect

When using a bag for a mobile device user with an adjustable support board according to the present invention, the following advantages are accomplished:

1. When using a mobile device, a user of the mobile device can use it very stably and conveniently and keep a proper posture of the user's body, which helps the user stay healthy.

2. An adjustable support board mounted on a bag of the present invention has an additional function as a bookrest onto which a general book as well as a mobile device can be held and used. Even in this case, a user can keep a proper posture, which gives the user much convenience and greatly helps the user stay healthy.

Further features and advantages of the present invention can be obviously understood with reference to the accompanying drawings where same or similar reference numerals indicate same components.

MODE FOR THE INVENTION

Hereinafter, the present invention will be described in more detail with reference to the embodiments of the present invention and the appended drawings.

Figure 1:
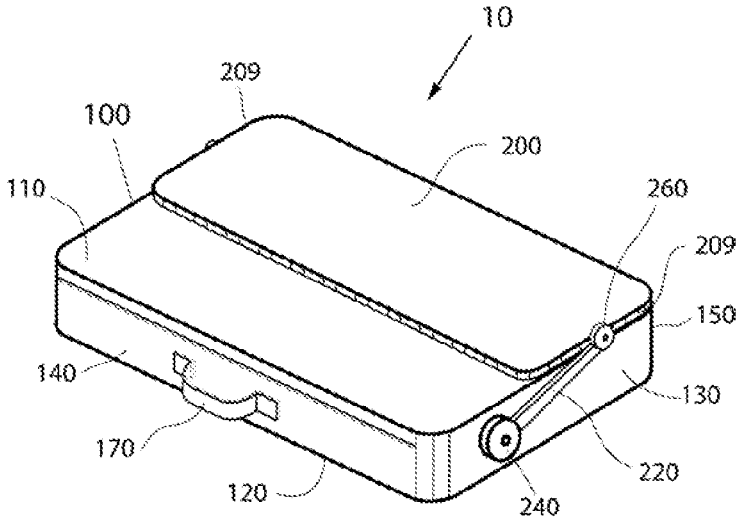
FIG. 1 illustrates a perspective view of a bag for a mobile device user according to one embodiment of the present invention.

FIG. 1 illustrates a perspective view of a bag for a mobile device user according to one embodiment of the present invention. Referring to FIG. 1, a bag 10 for a mobile device user according to one embodiment of the present invention comprises a body 100 of the bag; a support board 200; a support arm 220; a first multi-position fixing unit 240; and a second multi-position fixing unit 260.

The body 100 may be a main body of the bag 10 and has a handle 170 for lifting it by hand and small or large pockets (not shown), etc. The body 100 comprises a front side 110, a back side 120, lateral sides 130, a top side 140, and a bottom side 150. Here, the bag 10 includes a bag with no separate top side 140 in such a case that the front side 100 and the back side 120 are merged to form a slanting surface at a top position on which a handle is placed.

As illustrated in FIG. 1 above, an embodiment that the present invention is applied to a general type of a bag 10. The first multi-position fixing unit 240 is illustrated as being provided to the lateral sides 130 of the body 100. However, it should be noted that the first multi-position fixing unit 240 may be provided to the front side 110 of the body 100, such as an embodiment which will be described later with reference to FIG. 8.

Hereinafter, configurations and operations of a bag for a mobile device user according to the present invention will be described in more detail.

Figure 2:
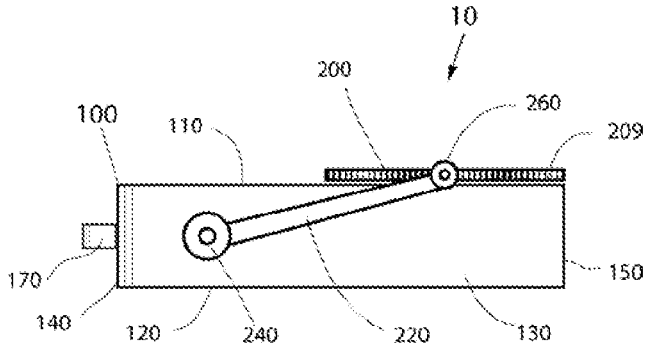
FIG. 2 illustrates a side view of a bag for a mobile device user according to an embodiment of the present invention.

FIG. 2 illustrates a side view of a bag for a mobile device user according to an embodiment of the present invention.

Referring to FIG. 2, it is illustrated that the bag 10 for a mobile device user according to an embodiment of the present invention is in a keeping or moving condition, while the support board 200 is in a closed position. When the support board 200 is not in use (e.g., in case of keeping or carrying the bag 10), the support board 200 is being placed to adjacently face the front side 110. The first multi-position fixing unit 240 provided on the lateral sides 130 is pivotally combined with the body 100, while the second multi-position fixing unit 260 provided on both sides 209 of the support board 200 is pivotally combined with the support board 200. One end of the support arm 220 is pivotally combined with the first multi-position fixing unit 240, while the other end thereof is pivotally combined with the second multi-position fixing unit 260. The support arm 220 can be rotated about the first multi-position fixing unit 240 in a first direction (counter-clockwise) and thus the support board 200 can be also rotated, upon rotation of the support arm 220, about the first multi-position fixing unit 240 in the first direction (counter-clockwise) with respect to the front side 110 to be open and then fixed at a desired position. Further, the support board 200 can be rotated about the second multi-position fixing unit 260, and then is adjusted at an angle desired by a user and fixed at that position. Although it is illustrated in the embodiments shown in FIGS. 1 and 2 that the second multi-position fixing unit 260 is pivotally combined with the both sides 209 of the support board 200, any skilled person in the art will fully appreciate that the second multi-position fixing unit 260 may be pivotally combined with a bottom side or outer side 204 (see FIG. 9*a* which will be described later) of the support board 200.

Figure 3A:
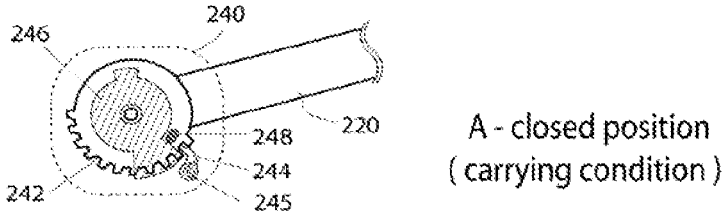
FIG. 3*a* illustrates a side view for explaining a configuration and an operational principle of a first multi-position fixing unit when a support board of the present invention illustrated in FIG. 1 is in a keeping position.
Figure 3B:
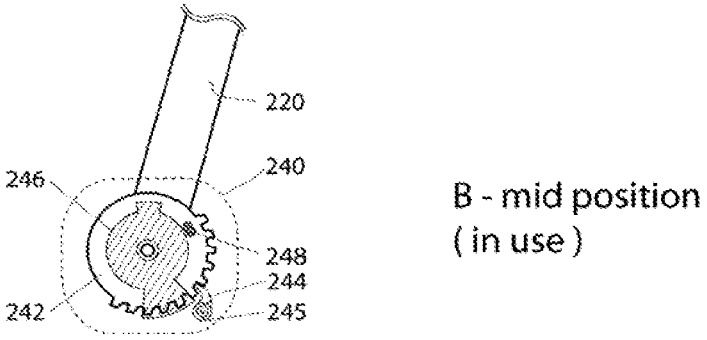
FIG. 3*b* illustrates a side view for explaining a configuration and an operational principle of a first multi-position fixing unit when a support board of the present invention illustrated in FIG. 1 is in an open position.
Figure 3C:
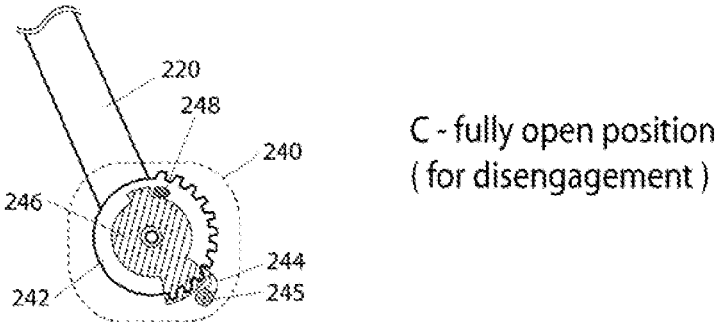
FIG. 3*c* illustrates a side view for explaining a configuration and an operational principle of a first multi-position fixing unit when a support board of the present invention illustrated in FIG. 1 is in a maximally open position.

FIG. 3*a* illustrates a side view for explaining a configuration and an operational principle of a first multi-position fixing unit when a support board of the present invention illustrated in FIG. 1 is in a rest position, FIG. 3*b* illustrates a side view for explaining a configuration and an operational principle of a first multi-position fixing unit when a support board of the present invention illustrated in FIG. 1 is in an open position, and FIG. 3*c* illustrates a side view for explaining a configuration and an operational principle of a first multi-position fixing unit when a support board of the present invention illustrated in FIG. 1 is in a maximally open position.

Referring to FIGS. 3*a* to 3*c* together with FIGS. 1 and 2, the first multi-position fixing unit 240 can be embodied by, e.g., a known ratchet wheel mechanism or a ratchet wheel assembly. Such a ratchet wheel mechanism or a ratchet wheel assembly includes a ratchet wheel 242, a stopper 244, a disengaging cam or a release cam 246 (hereinafter "release cam") and a push pin 248. The ratchet wheel 242 is formed with teeth (reference numeral is not shown) on a portion or a whole of an outer circumference thereof so as to be able to rotate about a coaxial common axis sharing a rotational axis. The push pin 248 is integrally coupled to a certain position inside the outer circumference of the ratchet wheel 242 so as to push and rotate the release cam 246 at a certain angle. The stopper 244 is designed to restrict a rotation of the ratchet wheel 242 in one direction (a clockwise direction in FIGS. 3*a* to 3*c*), while to allow a free rotation of the ratchet wheel 242 in opposite direction (a counter-clockwise direction in FIGS. 3*a* to 3*c*). Further, the stopper 244 always exerts biased restoring force toward a central direction of the ratchet wheel 242 by a restoring spring 245 and thus maintains an engagement state with the ratchet wheel 242, unless the stopper 244 is released by the release cam 246. In FIG. 3*a*, a configuration of a peripheral portion of the first multi-position fixing unit 240 illustrated in FIG. 2 is shown as an enlarged view. That is, it should be appreciated that, in FIG. 2, only one end of the partially cut support arm 220 and the first multi-position fixing unit 240 are combined and thus the support board 200 is being kept to adjacently face the front side 110. In FIGS. 3*a* to 3*c*, principal components of the ratchet wheel mechanism or a ratchet wheel assembly described in detail above can be configured to be included in a reception compartment within the first multi-position fixing unit 240 represented in a dotted line, and operational processes of the first multi-position fixing unit 240 are illustrated in sequence in the respective drawings. It is configured that the ratchet wheel 242, the release cam 246, and the stopper 244 can be pivotally rotated about the rotational axis shown in the respective drawings (reference numeral is not shown), while the rotational axis is fixed to the reception compartment so that the reception compartment is securely attached to one side of the body 100.

In FIG. 3*a*, when the support arm 220 is rotated in the first direction (e.g., the counter-clockwise direction), the support board 200 combined with the support arm 220 is also rotated together in the first direction, and thus the support board 200 is lifted from the front side 110. Even if rotational force is exerted to the support board 200 in the second direction under a state that the support board 200 is opened, the rotation of the ratchet wheel 242 is prevented in the second direction (e.g., the clockwise direction) opposite the first direction since the stopper 244 maintains an engagement state with the teeth of the ratchet wheel 242. After that, an open angle of the support arm 220 or an open position of the support board 200 is adjustable while being rotated in the first direction (the counter-clockwise direction) from a state shown in FIG. 3*a* to a state shown in FIG. 3*b*. When the rotation of the support arm 220 reaches a position as shown in FIG. 3*c* over the position shown in FIG. 3*b*, the push pin 248 provided on the ratchet wheel 242 pushes and rotates the release cam 248 in the first direction. After that, the release cam 248, in turn, pushes the stopper 244 in the clockwise direction and thus separates it from the teeth of the ratchet wheel 242 so as to release the engagement between the stopper 244 and the teeth of the ratchet wheel 242. When reaching the position shown in FIG. 3*c*, the support arm 220 becomes free to rotate and thus can be returned to the original position shown in FIG. 3*a*.

It is very desirable to apply the ratchet wheel mechanism or the ratchet wheel assembly described above to the bag of the present invention for safety purpose during the use thereof. Specifically, when the first multi-position fixing unit 240 combined with the support arm 220 is inadvertently released from its engagement therewith due to some manipulation errors, etc. during the use of the support board 200, the support board 200 is instantly rotated in the clockwise direction and thus is separated from the front side 110 so that a mobile device may fall and be damaged, and the user's hands or arms may possibly get injuries. Therefore, as in the embodiments described above, fixing unit 240, it is possible to remove the mobile device completely from the support board 200 after using the mobile device and then rotate the support board 200 completely in the first direction to return it back to its original position (closed position), which guarantees safety during the use of the bag 10.

Further, the ratchet wheel 242 may be installed on either one side or both sides of the lateral sides 130 of the body 100. In such a case, it is desirable that the ratchet wheel 242 is installed on both sides of the lateral sides 130 of the body 100 for operating the support board 200 stably while maintain a balance thereof. Although it is illustrated that the ratchet wheel mechanism or the ratchet wheel assembly described above is configured to include the components such as the ratchet wheel 242, the stopper 244, the release cam 246, and the push pin 248, etc., the ratchet wheel mechanism may not be necessarily configured only by the components described above. That is, any skilled person in the art will fully appreciate that any device embodying an operational principle capable of allowing the ratchet wheel 242 to be rotated in one direction and preventing it from being rotated in the other direction, while releasing the engagement thereof to be freely rotated at a certain angle interval, in lieu of the ratchet wheel mechanism or the ratchet wheel assembly.

Figure 4A:
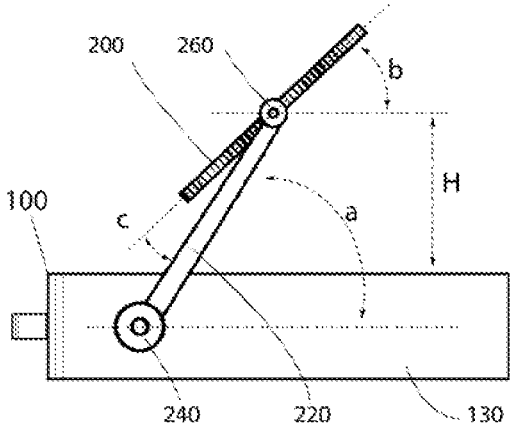
FIG. 4*a* illustrates a side view for showing a position of a support board where a support arm illustrated in FIG. 1 is rotated to a position by a certain angle.
Figure 4B:
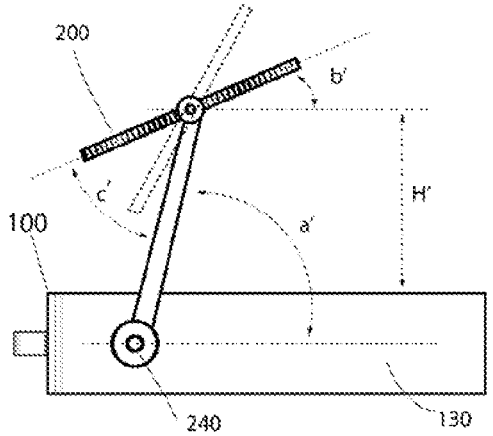
FIG. 4*b* illustrates a side view for showing a position of a support board where a support arm illustrated in FIG. 1 is rotated to a position which is placed at an angle further rotated than the certain angle illustrated in FIG. 4*a*.

FIG. 4*a* illustrates a side view for showing a position of a support board where a support arm illustrated in FIG. 1 is rotated to a position by a certain angle, and FIG. 4*b* illustrates a side view for showing a position of a support board where a support arm illustrated in FIG. 1 is rotated to a position which is placed at an angle further rotated than the certain angle illustrated in FIG. 4*a*.

Referring to FIG. 4*a*, when the support arm 220 is rotated to a certain angle a relative to the front side 110 in the first direction (the counter-clockwise direction), the support board 200 is also rotated in the first direction (the counter-clockwise direction) so as to be tilted to a certain angle b relative to the front side 110 in the first direction (the counter-clockwise direction). Further, the support board 200 rises to a height H from the front side 110 when viewing from the center point of the first multi-position fixing unit 240.

Referring to FIG. 4*b*, the support arm 220 is further rotated to a certain angle a' relative to the front side 110 in the first direction (the counter-clockwise direction), while the support board 200 rises more to a height H' from the front side 110, when compared to the respective positions shown in FIG. 4*a*. As a result, the support arm 220 is tilted to an angle b' relative to the front side 110, which is in a state to be further rotated in the first direction (the counter-clockwise direction). Therefore, the height of the support board 200 is adjustable by an angle of the support arm 220, and the tilting angle of the support board 200 is adjustable by a rotation of the second multi-position fixing unit 260.

Figure 5A:
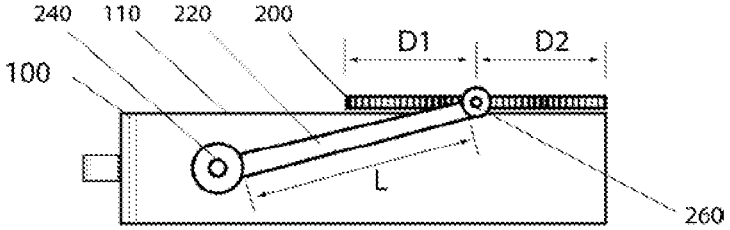
FIG. 5*a* illustrates a side view for explaining a relationship between a position of a second multi-position fixing unit and a length of a support arm.
Figure 5B:
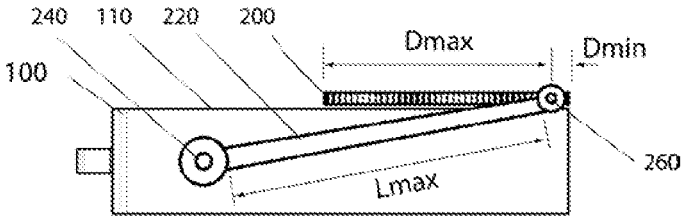
FIG. 5*b* illustrates a side view for showing a configuration that a length of a support arm of the present invention illustrated in FIG. 5*a* becomes maximized.
Figure 5C:
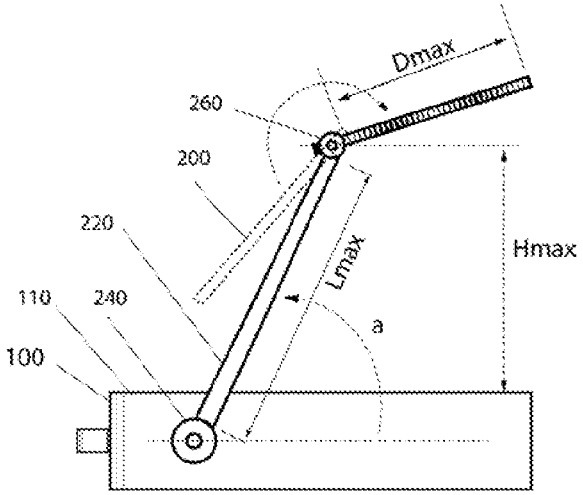
FIG. 5*c* illustrates a side view for showing a using position where a support board illustrated in FIG. 5*b* is maximally extended from a first multi-position fixing unit.

FIG. 5*a* illustrates a side view for explaining a relationship between a position of the second multi-position fixing unit 260 and a length of the support arm 220, FIG. 5*b* illustrates a side view for showing a configuration that a length of the support arm 220 of the present invention illustrated in FIG. 5*a* becomes maximized, and FIG. 5*c* illustrates a side view for showing a using position where the support board 200 illustrated in FIG. 5*b* is maximally extended from the first multi-position fixing unit 240.

Referring to FIG. 5*a*, the support board 200 is pivotally combined with the second multi-position fixing unit 260 so as to divide a whole length thereof into D1 to D2. In contrast, referring to FIG. 5*b*, the support board 200 is pivotally combined with the second multi-position fixing unit 260 in a manner that D1 shown in FIG. 5*a* has a maximum value Dmax, while D2 has a minimum value Dmin. In such a case of an embodiment illustrated in FIG. 5*b*, a length L of the support arm 220 can be extended to have a maximum length Lmax. In this case, as illustrated in FIG. 5*c*, when rotating the support board 200 in the second direction (the clockwise direction) after rotating and opening the support arm 220 by an angle a in the first direction (the counter-clockwise direction), the support board 200 can be maximally positioned toward outside from the second multi-position fixing unit 260. Further, it is possible to place the height of the support board 200 more higher, since it is possible to place the height of the second multi-position fixing unit 260 from the front side 110 to a height Hmax which is higher than the height H shown in FIG. 4*a*. Accordingly, in the embodiments illustrated in FIGS. 5*b* and 5*c*, it is possible to increase the height of the support board 200 maximally with a same sized bag 10 so that especially a user with a long height or arm can use conveniently the support board 200 mounted on the bag 10 of the present invention.

Figure 6A:
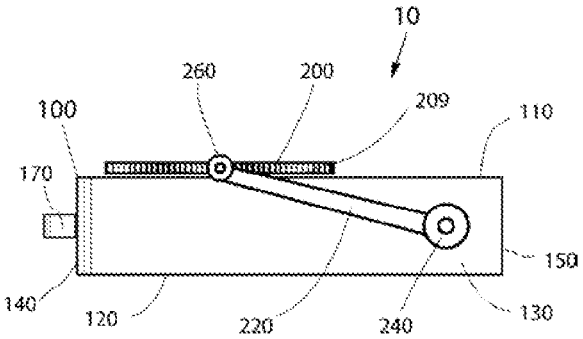
FIG. 6*a* illustrates a side view according to another embodiment of the present invention where an arrangement of components is changed in a bag of the present invention illustrated in FIG. 1.
Figure 6B:
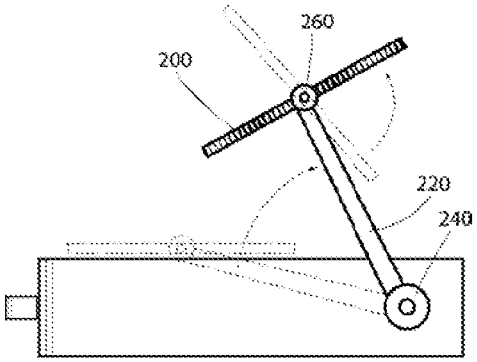
FIG. 6*b* illustrates a side view where a support board and a support arm are used in an open position in another embodiment illustrated in FIG. 6*a*.

FIG. 6*a* illustrates a side view according to another embodiment of the present invention where an arrangement of components is changed in a bag of the present invention illustrated in FIG. 1, and FIG. 6*b* illustrates a side view where a support board and a support arm are used in an open position in another embodiment illustrated in FIG. 6*a*.

Referring to FIG. 6*a*, unlike the arrangement shown in FIG. 5*a*, a configuration is illustrated that the first multi-position fixing unit 240 is provided closely to the bottom side 150, while the support board 200 is provided closely to the top side 140. That is, the support board 200, the first multi-position fixing unit 240, the support arm 220, and the second multi-position fixing unit 260 are provided in an approximately symmetrical configuration relative to a virtually vertical center line (not shown) of the lateral sides of the body 110. Accordingly, the support board 200, the support arm 220, the first multi-position fixing unit 240, and the second multi-position fixing unit 260 are same as above, but are different only in their rotational directions (operational directions) when compared to the embodiment shown in FIG. 5*a*, and other configurations and operational methods can be embodied as the same as those of the embodiment shown in FIG. 5*a*.

Referring to FIG. 6*b*, after the support arm 220 is opened in the second direction (the clockwise direction) from a state shown in FIG. 6*a*, the support board 200 is rotated in the first direction (the counter-clockwise direction) so that the fixing position and height of the support board 200 can be adjusted.

Referring again to FIGS. 4*a* to 6*b*, when the user may move the support board 200 in a tilted state toward a left direction in the respective figures during the use of the mobile device, the mobile device may fall if the support board 200 is rotated more in the first direction (the counter-clockwise direction) due to the load exerted on the support board 200. That is, after the support board 200 is adjusted to a needed angle, the support board 200 is required to be fixed to that position so as not to be rotated any more in the first direction (the counter-clockwise direction). Accordingly, the configuration of the second multi-position fixing unit 260 described above is desirable to be embodied by, but not limited to, a ratchet wheel mechanism or a ratchet wheel mechanism assembly like the first multi-position fixing unit 240 described above.

Further, since both lateral sides 209 of the support board 200 are provided with the second multi-position fixing unit 260, and the second multi-position fixing unit 260 and support arm 220 are pivotally combined, the support board 200 and the support arm 220 are configured to be able to move in a mutual rotation. In such a case, since a rotational angle of the second multi-position fixing unit 260 for adjusting a tilting angle or a titling position of the support board 200 is within an angle range which is much more limitedly allowable compared to the rotational angle of the first multi-position fixing unit 240, the second multi-position fixing unit 260 can be embodied by a relatively simpler configuration than that of the first multi-position fixing unit 240.

More specifically, the second multi-position fixing unit 260 can be embodied, for example, by using a known device such as a free stop hinge device, a swing hinge device, a friction hinge device, or a step hinge device, etc.

Figure 7A:
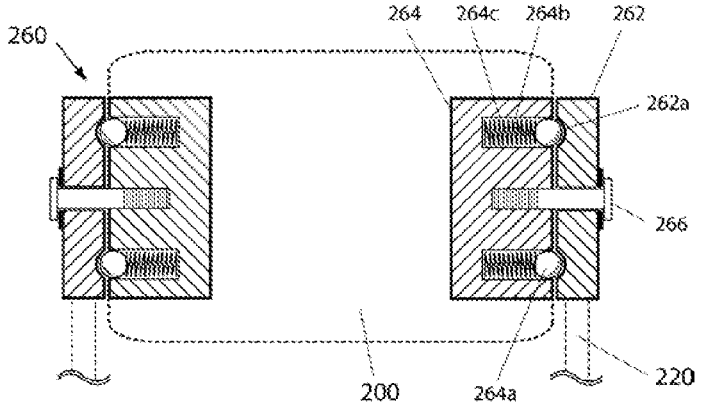
FIG. 7*a* illustrates a cross-sectional view for showing an embodiment of a configuration of a second multi-position fixing unit.

FIG. 7*a* illustrates a cross-sectional view for showing an embodiment of a configuration of a second multi-position fixing unit, and FIG. 7*a* illustrates a cross-sectional view for showing another embodiment of a configuration of a second multi-position fixing unit.

Referring to FIG. 7*a*, the second multi-position fixing unit 260 comprises a circular plate 262 which has a plurality of hemispherical cavities 262*a* along a circumferential direction and is coupled to the support arm 220; and a pairing plate 264 which has a plurality of cylindrical holes 264*c* formed at opposite positions corresponding to the plurality of hemispherical cavities 262*a*, a plurality of springs 264*b* included in the plurality of cylindrical holes 264*c*, and a plurality of balls 264*a* provided between outer ends of the plurality of springs 264*b* and is coupled to the support board 200. The circular plate 262 and the pairing plate 264 of the second multi-position fixing unit 260 are rotatable relatively with each other about a coaxial common axis 266 as a rotational center. That is, when the circular plate 262 coupled to the support arm 220 and the pairing plate 264 coupled to the support board 200 are rotated relatively upon being exerted rotational force, some portions of spherical surfaces of the plurality of balls 264*a* are moved into the hemispherical cavities 262*a* of the circular plate 262 and maintain an engagement of the circular plate 262 and the pairing plate 264 so that the rotation of the circular plate 262 and the pairing plate 264 is prevented. After that, when a certain amount or more of rotational torque is exerted on the pairing plate 264 in order to release the engagement of the pairing plate 264 and the circular plate 262, the plurality of balls 264*a* leaves from the hemispherical cavities 262*a* and is displaced, and then the plurality of balls 264*a* moves again into the other hemispherical cavities 262*a* due to resilient force of the plurality of springs 264*b*. After that, the pairing plate 264 and the circular plate 262 maintain their engagement state at the displaced position. In this case, as the pairing plate 264 rotates, the support board 200 coupled to the pairing plate 264 also becomes to maintain its rotation or engagement state. Accordingly, the second multi-position fixing unit 260 can adjust the tilting angle or tilting position of the support board 200 by a relative rotation of the pairing plate 264 and the circular plate 262. It is desirable for the circular plate 262 to be embodied by a disk shape with a certain width. However, the pairing plate 264 is not necessarily embodied in a form of a disk circular shape, but can be embodied by any shape (e.g., a rectangular shape) for simply receiving two balls and springs as illustrated in the figure.

Figure 7B:
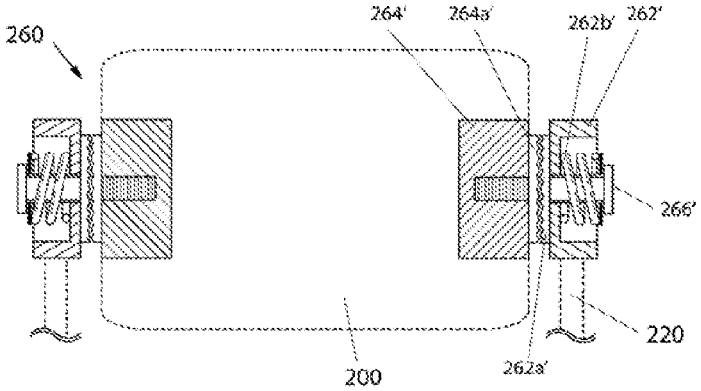
FIG. 7*b* illustrates a cross-sectional view for showing another embodiment of a configuration of a second multi-position fixing unit.

Referring to FIG. 7*b*, the second multi-position fixing unit 260 is embodied by a circular plate 262' having a first serration member 262*a*', a pairing plate 264' having a second serration member 264*a*', and a coil spring member 262*b*' being provided outside the circular plate 262' and pressing the first serration member 262*a*' in an axial direction for the first serration member 262*a*' and the second serration member 264' to be engaged. The teeth formed on the first serration member 262*a*' and the second serration member 264', respectively, are engaged each other by the biasing force of the coil spring member 262*b'*.

More specifically, the circular plate 262' and the pairing plate 264' can be relatively rotatable about a coaxial common axis. When the circular plate 262 coupled to the support arm 220 and the pairing plate 264 coupled to the support board 200 are rotated relatively with each other, the first serration member 262*a*' and the second serration member 264' are engaged with each other by the coil spring member 262*b*' so that the rotational movement between the circular plate 262' and the pairing plate 264' is restricted. However, when rotational force exceeding a certain amount of rotational torque or more is exerted on the pairing plate 264' for releasing the engagement state of the pairing plate 264' and the circular plate 262', the first serration member 262*a*' and the second serration member 264*a*' are released from their engagement and thus displaced. After that, the engagement state between the pairing plate 264' and the circular plate 262' can be maintained as it is at the displaced position unless any external force is exerted additionally between the first serration member 262*a*' and the second serration member 264*a'*.

Meanwhile, in order to make the configuration of the second multi-position fixing unit 260 simpler than the embodiments shown in FIGS. 7*a* and 7*b*, the second multi-position fixing unit 260 is configured that frictional torque can be provided between the circular plate 262 and the pairing plate 264 by inserting a resilient member such as a plurality of disk springs (not shown) between circular plate 262 and the pairing plate 264. Further, a configuration of the second multi-position fixing unit 260 is possible to provide a frictional hinge member in a manner of making a torque control bush (not shown) made of metal or polymer resin material in a pipe shape and inserting it into the coaxial common axis 266,266' which allows assembly tolerance at a relatively low level. In this case, the when a rotational movement occurs between the torque control bush and the circular plate 262,262', frictional torque is exerted on the circular plate 262,262' and thus the rotational movement of the support board 200 is prevented.

As described above in detail, any skilled person in the art will fully appreciate that the first multi-position fixing unit 240 and the second multi-position fixing unit 260 can be embodied by a combination of various prior arts.

Figure 8:
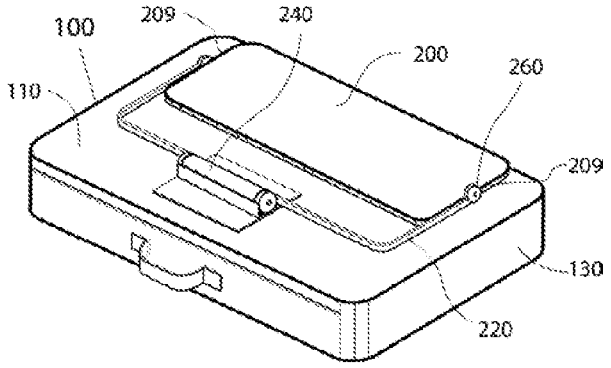
FIG. 8 illustrates a perspective view for showing another embodiment of a first multi-position fixing unit.

FIG. 8 illustrates a perspective view for showing another embodiment of a first multi-position fixing unit.

Referring to FIG. 8, the first multi-position fixing unit 240 is provided on the front side 110 of the body 100. In the first multi-position fixing unit 240 shown in FIG. 1, some interference with the lateral sides 130 may occur, or a width of the body 100 may be increased due to a width of the first multi-position fixing unit 240. Accordingly, in a case where the first multi-position fixing unit 240 is provided on the front side 110 of the body 100 as shown in FIG. 8, it is possible to solve the problems relating to the interference with the lateral sides 130 or an increase in width of the body 100. The first multi-position fixing unit 240 shown in FIG. 8 can be configured similarly, for example, as the ratchet wheel mechanism or the ratchet wheel assembly shown in FIGS. 3*a* to 3*c*. In such a case, it is desirable to configure to decrease a diameter of the ratchet wheel 242 substantially and increase a width of the ratchet wheel 242 so as to hold fully the rotational torque exerted on the ratchet wheel 242. Further, in FIG. 8, it is possible to configure the first multi-position fixing unit 240 in a manner that it can be freely rotated in the first direction (the counter-clockwise direction), but the rotation in the second direction (the clockwise direction) can release an engagement state at any position by way of manipulating the stopper (not shown) manually. Although the second multi-position fixing unit 260 is illustrated to be pivotally combined with the both sides 209 of the support board 200 in the embodiment shown in FIG. 8 as described above in detail, any skilled person in the art will fully appreciated that the second multi-position fixing unit 260 may be combined with the bottom side or the outer side 204 (see FIG. 9*a* which will be described later).

In the bag 10 for a mobile device user of the present invention, since an object such as a hand, an arm, and a mobile device may be placed on the support board 200, substantially heavy force may be loaded on the support board 200 due to the weight thereof. Due to the load and the length of the support arm, a rotational moment exerted on the first multi-position fixing unit 240 through the support arm 220 has a relatively large value when compared to that of the second multi-position fixing unit 260. Accordingly, it should be noted that the first multi-position fixing unit 240 is configured solidly to bear relatively strong rotational force. To the contrary, since the rotational force exerted on the second multi-position fixing unit 260 is relatively very small when compared to the rotational force exerted on the first multi-position fixing unit 240, the second multi-position fixing unit 260 can be configured by a relatively light and small sized member by replacing it with any one or more of a free stop hinge device, a swing hinge device, a friction hinge device, or a step hinge device as described above.

Further, a height and an open angle (an open position) of the bag 10 and the support board 200 required for each mobile device user may vary depending on the individual height and posture preference of each mobile device user. Accordingly, when viewing from a sitting posture, it is possible to use the support board 200 by adjusting the respective rotational angles through rotational manipulations of the first multi-position fixing unit 240 and the second multi-position fixing unit 260 so as to adjust a use position of the support board 200, after placing the bag 10 of the present invention on a lap in an approximately horizontal state depending on each user's convenience Further, it is desirable for the support board 200 to be made of a rigid material with high stiffness enough to support the maximum load, since the load exerted on the support board 200 can be increased greatly when placing the user's hand and arm as well as the mobile device thereon. At the same time, it is also required for the support board 200 to be made of a light plate-shaped material such as light plastic resin, light wooden material and light metal material, considering the portability of the bag 10.

Meanwhile, when the user just watches videos and moving images, etc. without using hands or arms by placing the mobile device on the support board 200 (i.e., a case of placing the mobile device on the support board 200 while using the mobile device without holding it by hand), it is necessary to provide a configuration for preventing the mobile device from sliding downward from the support board 200 due to gravity.

Figure 9A:
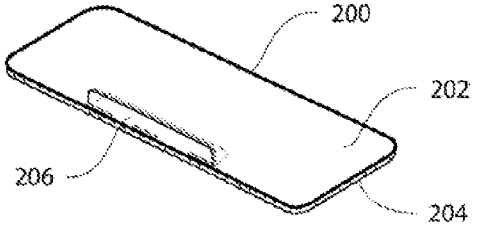
FIG. 9*a* illustrates a perspective view for showing an embodiment where a support board illustrated in FIG. 1 is additionally provided with a ledge member.
Figure 9B:
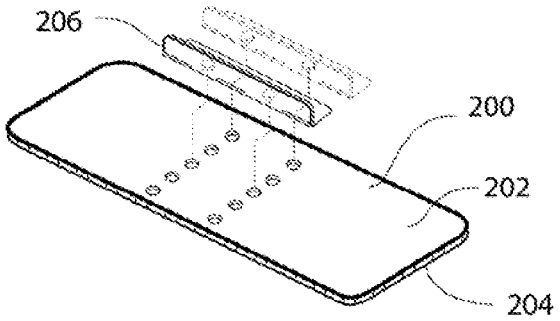
FIG. 9*b* illustrates a perspective view for showing an embodiment where a position of a ledge member illustrated in FIG. 9*a* is variable.

More specifically, FIG. 9*a* illustrates a perspective view for showing an embodiment where a support board illustrated in FIG. 1 is additionally provided with a ledge member, and FIG. 9*b* illustrates a perspective view for showing an embodiment where a position of a ledge member illustrated in FIG. 9*a* is variable.

First, referring to FIG. 9*a*, the support board 200 may include a ledge member 206 additionally at a lower position of an inner surface 202 thereof in order to prevent the mobile device from sliding down. Since the ledge member 206 may cause inconvenience due to interference with some protruding portion thereof, the ledge member 206 can be kept without being protruded by configuring the ledge member 206 to be folded in a hinge type with the inner surface 202 of the support board 200 and to be laid flatly thereover, when the support board 200 is not being used. Although it is only illustrated in FIG. 9*a* that the ledge member 206 is provided at the lower position of the support board 200, the ledge member 206 may be positioned at any required place on the support board 200.

Referring to FIG. 9*b*, the inner surface 202 of the support board 200 and the ledge member 206, may be detachably provided, for example, by a known attachment art such as a magnet attachment type, etc. Accordingly, the position of the ledge member 206 may be changed freely at any place on the support board 200. In this case, a known attachment method may be accomplished by applying any one of various prior arts including a velcro type, a snap button type, a bolt and nut type, and a hook type, etc. or any combination thereof.

Figure 10:
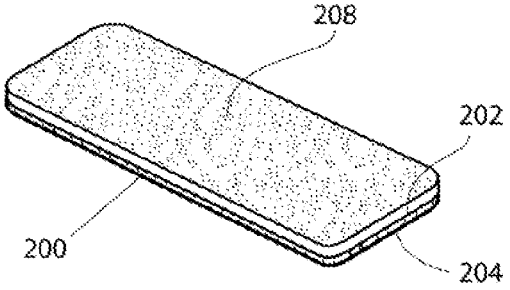
FIG. 10 illustrates a perspective view for showing an embodiment where a support board illustrated in FIG. 1 is additionally provided with a resilient layer member.

FIG. 10 illustrates a perspective view for showing an embodiment where a support board illustrated in FIG. 1 is additionally provided with a resilient layer member.

Referring to FIG. 10, it is illustrated that a resilient layer member 208 is additionally provided on the inner surface 220 of the support board 200 which is used on the bag 10 for a mobile device user according to the present invention. In this case, the resilient layer member 208 may be provided on at least a partial or whole area of the inner surface 202 of the support board 200, and may be embodied by known resilient materials such as, e.g., rubber, sponge, latex resin, flexible PVC, expandable urethane resin, or air cushion, etc. This resilient layer member 208 provides a cushion function for supporting the user's skin and bone-muscle softly when placing the user's hands or arms on the support board 200 so that the user can use the mobile device comfortably, while helping blood circulation smoothly and without feeling fatigue even using the mobile device for a long time. Further, the resilient layer member 208 also provides a function for protecting the mobile device itself by reducing an impact on the mobile device and any possible scratch occurring on a casing of the mobile device.

Figure 11:
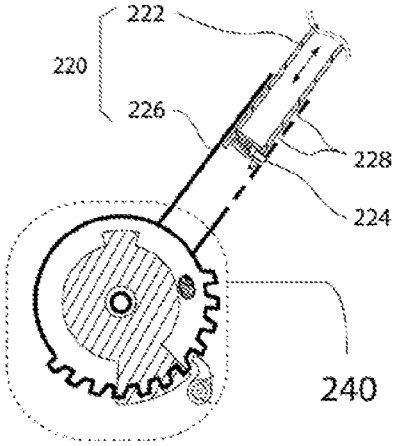
FIG. 11 illustrates a cross-sectional side view for showing an embodiment where a support arm has a length-adjustable configuration.

FIG. 11 illustrates a cross-sectional side view for showing an embodiment where a support arm has a length-adjustable configuration.

Referring to FIG. 11, the support arm 220 is configured for the length thereof to be adjustable appropriately. For example, the support arm 220 may comprise a first arm 222 having a spring button 224; and a second arm 226 having a plurality of locking-holes 228. Here, the first arm 222 is an inner arm 222, and the second arm 226 is an outer arm 226. The whole length of the support arm 220 can be adjusted through engagement or release of the spring button 224 and the plurality of locking-holes 228.

Further, the whole length of the support arm 220 can be adjusted alternatively by combining securely in an assembling manner using a bolt member and a nut member after setting the lengths of the a first arm 222 and the second arm 226 appropriately (not shown). Besides, it is possible to set the height of the support board 200 to be fitted to the user's body condition by adjusting the length between the first arm 222 and the second arm 226 using a various known method of length adjustment. Although a geometric configuration of the support arm 220 is illustrated as a linear type in FIG. 11, the support arm 220 can have a configuration of a curved type or an angled type, depending on necessity of its function and design.

Figure 12:
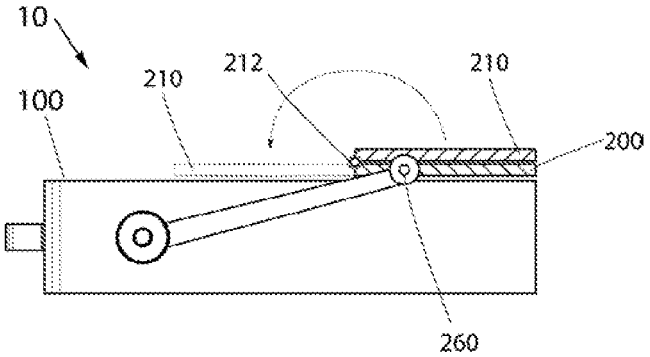
FIG. 12 illustrates a side view for showing an embodiment where a support board has an expandable structure.

FIG. 12 illustrates a side view for showing an embodiment where a support board has an expandable configuration.

Referring to FIG. 12, the support board 200 may include additionally a foldable type top board 210 on the support board 200. In this case, the top board 210 has a folding configuration with the support board 200 as a foldable type by a hinge member 212 and accordingly the top board 210 is pivotally combined with the support board 200. When placing and using a relatively wide-sized tablet PC on the support board 200 or placing and reading a big-sized book thereon, only the support board 200 described above may not have an available area enough to place objects thereon. In this case, it is possible to extend the available area on the support board 200 by unfolding the top board 210 provided on the support board 200 in order to extend a scanty area.

Meanwhile, in order for the configuration of the first multi-position fixing unit 240 to be securely provided to the body 100 of the bag 10, it is desirable that a rigid support frame capable of supporting the main components described above by combining the rigid support frame with them is provided inside or outside of the body 100.

Figure 13A:
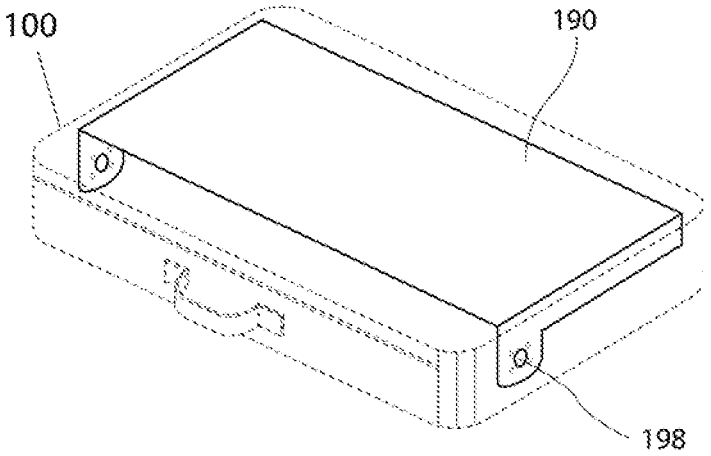
FIG. 13*a* illustrates a perspective view for showing an embodiment where a support frame is additionally provided inside a bag according to the present invention.
Figure 13B:
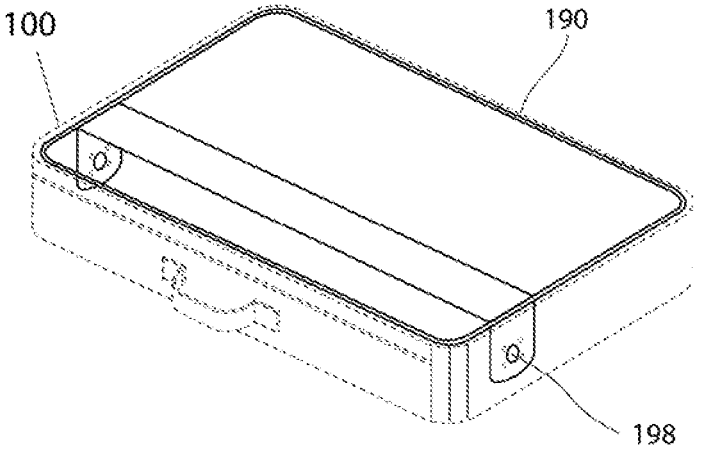
FIG. 13*b* illustrates a perspective view for showing another embodiment where a support frame is additionally provided inside a bag according to the present invention.

More specifically, FIG. 13*a* illustrates a perspective view for showing an embodiment where a support frame is additionally provided inside a bag according to the present invention, and FIG. 13*b* illustrates a perspective view for showing another embodiment where a support frame is additionally provided inside a bag according to the present invention.

Referring to FIG. 13*a*, the bag 10 according to the present invention is additionally provided with a support frame 190 for fixing securely the first multi-position fixing unit 240 provided on the front side 110 or the lateral sides 130 inside of the bag 10. The first multi-position fixing unit 240 is assembled on an attachment surface 198 of the support frame 190 by a rivet or a bolt and nut, etc., or is combined therewith by any one of a known method of a welding, a joint, and a fusion, etc. or any combination thereof. It is desirable to configure the support frame 190 as a light type board using plastic resin and a metal material.

Referring to FIG. 13*b*, it is illustrated that the support frame 190 is configured by a combination of a metal wire or a metal rod with a board. The support frame 190 can be configured in a various type depending on a design or usage of the bag 10, besides the configuration shown in the figure.

Generally, the bag 10 is classified as a soft shell bag and a hard shell bag according to the outer material of the bag 10. If the bag 10 is covered by a soft shell member, such as soft cloth of textile material, a synthetic material, or a leather material, it is called as a soft shell bag, while if the bag 10 is covered by a hard shell member with rigidity and stiffness, such as a hard plastic resin or a metal material, it is called as a hard shell bag.

In case of the bag made of a shell member, since it is possible to configure to combine the first multi-position fixing unit 240 directly with an outer surface or an inner surface of a hard shell securely and to support the first multi-position fixing unit 240, the hard shell itself can be the support frame 190 for supporting the first multi-position fixing unit 240.

In the meantime, even in case of a soft shell bag, the soft shell bag may have a function of the support frame 190 by configuring a hard shell member to be provided on a partial or whole area of any one side of the body 100 as illustrated in FIGS. 13*a* and 13*b*, and thus the first multi-position fixing unit 240 is securely supported to the bag 10.

As described above, in case that the bag 10 of the present invention is embodied by a hard shell bag, the bag 10 itself may provide a function of the support frame 190 as well as a function of protecting the contained articles inside the bag 10 from external impact.

Figure 14:
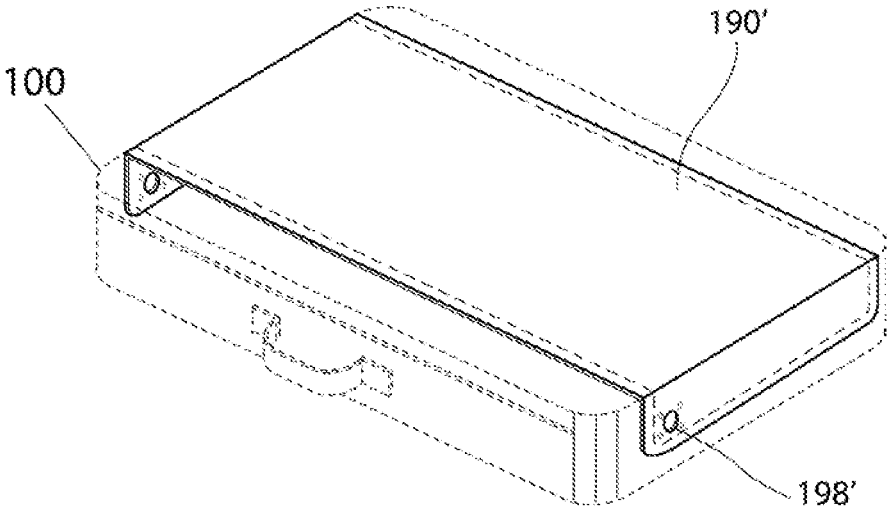
FIG. 14 illustrates a perspective view for showing an embodiment where a hard shell support frame is additionally provided to a portion of a bag according to the present invention.
Figure 15:
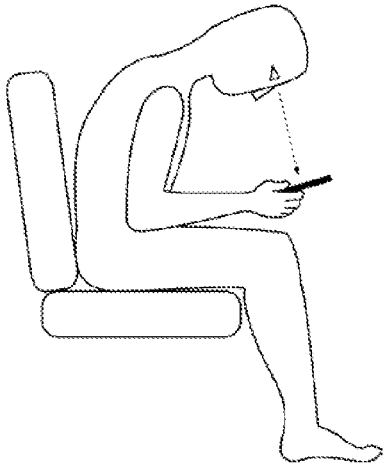
FIG. 15 illustrates a side view for showing a typical posture of the user while holding a mobile device in a bad position.

More specifically, FIG. 14 illustrates a perspective view for showing an embodiment where a hard shell support frame is additionally provided to a portion of a bag according to the present invention.

Referring to FIG. 14, the bag 10 according to the present invention is provided by replacing a hard shell member 190' partially on at least a portion of the front side 110 and at least a portion of the lateral sides 130, and by assembling the first multi-position fixing unit 240 on an attachment face 198' of the hard shell member 190' by a rivet or a bolt and nut, etc., or by combining it therewith by any one of a known art of a welding, a joint, and a fusion, etc. or any combination thereof. Further, the soft shell member and the hard shell member can be joined by a various method of a known art such as a sawing, a fusion, an adhesive, a rivet, and a button, etc. or any combination thereof.

When configuring the hard shell described above by applying high stiffness engineering plastic resin (e.g., polycarbonate resin or FRP resin), or functional fiber reinforcement containing other carbon fiber, Kevlar fiber, etc., a bullet-proof function can be introduced so as to provide a function of protecting a human body from a firearm accident. As the support frame 190 shown in FIGS. 13*a* to 14 is exemplary, it is obvious that the support frame 190 can be transformed to a various configuration depending on types and shapes of the bag 10.

Further, the bag 10 according to the present invention includes a various type of bags in its widest meaning including a handbag, a brief case, a bag for smart pad, a bag for notebook, a shoulder bag, a handbag, a cross-bag, a backpack, etc.

Figure 16:
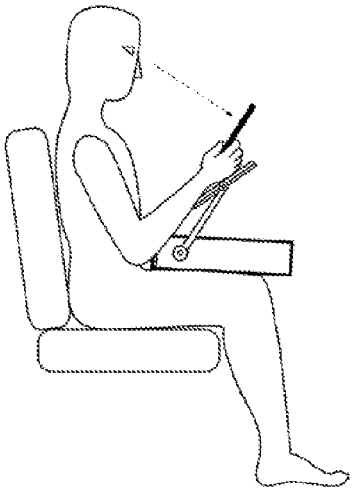
FIG. 16 illustrates a side view of a desirable posture of the user where the user is holding a mobile device while using a bag according to the present invention.

FIG. 16 illustrates a side view of a desirable posture of the user where the user is holding a mobile device while using a bag according to the present invention.

Referring to FIG. 16, in the bag 10 according to the present invention, a user puts the body 100 on a lap or thigh of a user and then opens the support arm 220 to a desired angle by lifting the support board 200 upward. After that, the user adjusts and fixes a tilting angle of the support board 200 appropriately. After that, the user can use a mobile device comfortably and in a proper posture by placing the mobile device on the opened support board 200 or placing the user's hand and arm for holding the mobile device thereon. As shown in FIG. 16, when using the bag 10 according to the present invention, it is fully understandable that the user can keep a proper posture in terms of the user's body, while the usage aspect is very stable and convenient.

Further, the bag 10 of the present invention can be used as a bookrest, because books can be placed on the support board 200.

Figure 17:
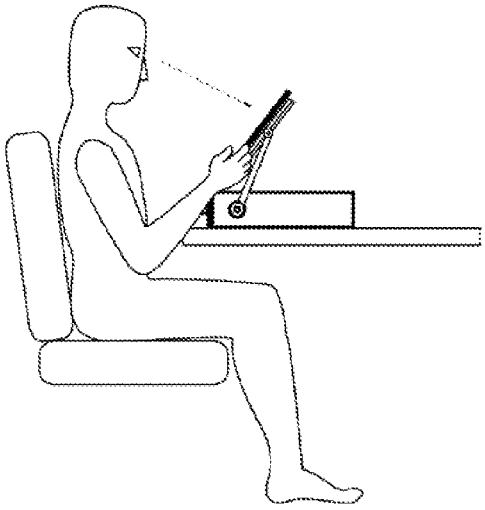
FIG. 17 illustrates a side view of a desirable posture of the user where the user is holding a mobile device while placing a bag on a desk according to the present invention.

More specifically, FIG. 17 illustrates a side view of a desirable posture of the user where the user is holding a mobile device while placing a bag according to the present invention on a desk.

Referring to FIG. 17, when opening and fixing the support board 200 by a desired angle appropriately while placing the bag 10 of the present invention horizontally on a desk, the bag 10 can be used for a mobile device and can be used conveniently as a bookrest as well. In case that even when the bag 10 of the present invention is used as a bookrest, the bag 10 of the present invention can advantageously provide convenience as well as help to the user's health, since it helps the user to keep a proper posture.

INDUSTRIAL APPLICABILITY

As various modifications could be made in the constructions and method herein described and illustrated without departing from the scope of the present invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A bag for a mobile device user comprising:

a body having a front side, a back side, lateral sides, a top side, and a bottom side;

a support board being placed on the front side;

a first multi-position fixing unit being pivotally provided to the lateral sides or the front side;

a second multi-position fixing unit being provided to both sides, a bottom side, or an outer side of the support board, and being pivotally combined with the support board; and a support arm in which one end of the support arm is pivotally combined with the first multi-position fixing unit, while the other end of the support arm is pivotally combined with the second multi-position fixing unit, wherein a position of the second multi-position fixing unit is adjusted by a rotational movement of the first multi-position fixing unit, and a tilting angle of the support board is adjusted by a rotational movement of the second multi-position fixing unit.

2. The bag for a mobile device user of claim 1, wherein the first multi-position fixing unit is embodied by a ratchet wheel mechanism.

3. The bag for a mobile device user of claim 1, wherein the second multi-position fixing unit is embodied by a ratchet wheel mechanism, or by any one of a swing hinge device, a free stop hinge device, and a friction hinge device or any combination thereof.

4. The bag for a mobile device user of claim 1, wherein the support board is provided with a resilient layer member on at least a partial area of either one or both sides thereof.

5. The bag for a mobile device user of claim 1, wherein the support board is provided with a ledge member for preventing the mobile device from falling down.

6. The bag for a mobile device user of claim 1, wherein the bag further includes a support frame, being provided on at least a partial area of the body, for supporting the multi-position fixing unit.

7. The bag for a mobile device user of claim 1, wherein at least a part of the body is made of a hard shell member.

8. The bag for a mobile device user of claim 1, wherein a length of the support arm is adjustable.

9. The bag for a mobile device user of claim 1, wherein the support board further includes a foldable type top board.

* * * * *